US006138284A

United States Patent [19]

Arai

[11] Patent Number: 6,138,284

[45] **Date of Patent: *Oct. 31, 2000**

[54] HELMET

[76] Inventor: Michio Arai, c/o Arai Helmet, Ltd., 12 Azuma-cho 2-chome, Ohmiya-shi, Saitama-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/227,144

[22] Filed: Jan. 8, 1999

[30] Foreign Application Priority Data

Jul. 31, 1998 [JP] Japan ..... 10-217198

[51] Int. Cl.[7] ..... A42B 3/12

[52] U.S. Cl. ..... 2/414

[58] Field of Search ..... 2/410, 411, 414, 2/421, 424, 425

[56] References Cited

U.S. PATENT DOCUMENTS

| | | | |
|---|---|---|---|
| 4,916,759 | 4/1990 | Arai | 2/414 |
| 5,088,129 | 2/1992 | Kamata | 2/411 |

FOREIGN PATENT DOCUMENTS

| | | |
|---|---|---|
| 1214865 | 4/1960 | France . |
| 2285823 | 4/1976 | France . |
| 8317310 | 10/1983 | Germany . |
| 58-45325 | 3/1983 | Japan . |
| 6-23527 | 6/1994 | Japan . |
| 10-25614 | 1/1998 | Japan . |
| 178003 | 2/1992 | Taiwan . |
| 9005464 | 5/1990 | WIPO . |

*Primary Examiner*—Michael A. Neas
*Attorney, Agent, or Firm*—Dykema Gossett PLLC

[57] ABSTRACT

A helmet providing superior comfort includes cheek pads that include a cushion member and a soft plane-like member (plate material, sheet material) having a reduced extension or shrinkage and not damaging the helmet wearing person adhered to a slant surface of a protrusion of the cushion member projecting from the shell installing surface of the cheek pads at both sides of the shell, and the extension or shrinkage of the protrusion is restricted to assure a desired strength at the protrusion, thereby the bending deformation of the protrusion at the time of installation is restricted. The bending deformation of the protrusion is restricted to cause the protrusion to be tightly abutted against the cheeks and the chin of the helmet wearing person when wearing the helmet.

2 Claims, 4 Drawing Sheets

HELMET

BACKGROUND OF THE INVENTION

1. Field of the Invention

This invention relates to a helmet for use in protecting the head and the face of a user when reducing on various kinds of motorized vehicles such motorcycles and automobiles, and more particularly an improvement of a cheek installing member (the chin pad) installed inside a shell of the helmet.

2. Description of the Prior Art

A comfortable feeling of this type of helmet is maintained by a repelling resilient force of a cushion member composed of urethane arranged inside a shock absorbing liner constituted by expanded polystyrene foam or the like fitted to and arranged at the shell or an inside part of the shell.

In particular, the cushion member for the chin pad for use in pressing the chin part from the cheek portions arranged at both right and left sides of the shell substantially contributes to making the helmet comfortable, wherein a recovering force caused by the repelling resilient force may be applied to the cushion member to be abutted against the cheeks and the chin and crushed when the driver wears the helmet, and then its recovering force causes the cushion member to be closely contacted with both cheeks.

SUMMARY OF THE INVENTION

There has been proposed an open face type helmet having a structure as disclosed in the gazette of Japanese Utility Model Laid-Open No. Sho 58-45325 so as to attain the aforesaid making helmet comfortable.

This open face type helmet is made such that the cushion member constituting the cheek pads installed at both inner sides of the shell has a wider cheek contact area than the shell connecting area and is projected out of the edges of the shell at both sides, wherein an area for holding the chin portion from the cheeks is widened by the projecting section of the cushion member to improve comfort and a more positive feeling of wearing the helmet can be attained.

However, although such a method as described above improves comfort by expanding an area to press the chin portion from the cheeks with the projection, the projection is not provided with any supporting member for the shell, resulting in that the projection is curved and deformed when the driver wears the helmet and so a positive feeling of wearing helmet may not be attained. This fact may also be applicable to the full-face type helmet, wherein it is a present situation that the cheek pads projected from the shell connecting part with the cheek contacting area being set to be wider than the limited shell connecting area is also poor in its strength and a positive feeling of wearing helmet can not be attained completely.

The present invention has been completed in reference to the aforesaid prior art circumstances and it is an object of the present invention to provide a helmet having a superior comfortable wearing feeling.

In order to accomplish the aforesaid object, the present invention has employed the following technical means.

The technical means according to first aspect of the present invention consists in a helmet having a structure in which the cheeks of a helmet wearing person are pressed by cheek pads installed at inside portions of both side sections to restrict a looseness of the helmet, wherein protrusions having the surfaces of a cushion member at a shell side applied as slant surfaces inclined toward the surfaces of the cheek portions in a thickness direction are cooperatively arranged at a front or lower section of the cushion member for said cheek pads, thereby the surfaces of the cheek pads contacted with the face of the helmet wearing person are made to be larger than those supported at the shell side and at the same time a soft plane-like member having a less amount of extension or shrinkage and not damaging the helmet wearing person is adhered to the slant surfaces, extension or shrinkage of the cushion member near the slant surfaces is restricted and a desired strength is also assured at the protrusions.

The technical means according to second aspect of the present invention consists in a helmet having a structure in which the cheeks of a helmet wearing person are pressed by cheek pads installed at inside portions of both side sections to restrict a looseness of the helmet, wherein protrusions having the surfaces of a cushion member at a shell side applied as slant surfaces inclined toward the surfaces of the cheek portions in a thickness direction are cooperatively arranged at a front or lower section of the cushion member for said cheek pads, thereby the surfaces of the cheek pads contacted with the face of the helmet wearing person are made to be larger than those supported at the shell side and at the same time a soft molded plate not damaging the wearing person which is molded to be adapted for a location ranging from the slant surfaces to the shell installing surfaces of the cheek pads are adhered, and extension or shrinkage of the cushion member near the slant surfaces is restricted and a desired strength is also assured at the protrusions.

The plane-like member according to first aspect of the present invention is meant by either a plate material or a sheet material or the like in which a thin raw material having such a strength as one at least not damaging the helmet wearing person is applied and formed into a desired shape.

In accordance with the technical means defined in first aspect of the present invention, a soft plane-like member (plate member, sheet member) having a less amount of extension or shrinkage and not damaging the helmet wearing person is adhered to the slant surfaces of the cushion member projected from the shell installing surfaces of the cheek pads at both sides of the shell, extension or shrinkage of the cushion member is restricted with the soft plane-like member and a desired strength is also assured at the protrusions, so that a curving deformation of the protrusions at the time of wearing helmet is restricted.

The curved deformation of the protrusions is restricted to cause the protrusions to be tightly abutted against the cheek portions and the chin portion of the helmet wearing person when the person wears the helmet.

In accordance with the technical means according to second aspect of the present invention, the soft molded plate not damaging the helmet wearing person which is molded to be in compliance with the location ranging from the surface of the cushion member installed at the shell to the slant surfaces is adhered, thereby the extending or shrinkage of the protrusions is restricted by the molded plate to cause the desired strength to be assured in the protrusions, resulting in that the curved deformation of the protrusions is restricted.

Due to the fact that the curved deformation of the protrusions is restricted, the protrusions are tightly abutted against the cheek portions and the chin portion of the helmet wearing person when the person wears the helmet in the same manner as that of first aspect of the present invention.

Since the molded plate has a shape corresponding to the shape of the slant surfaces from the installing surface of the cushion member against the shell and at the same time the location positioned at the shell installing surface is held by the cushion member and the shell, a force shrinking inward (a spring force) may be acted upon the protrusions which are apt to be widened outwardly by the cheek portions and the chin portion of the helmet wearing person, resulting in that a contact force of the protrusions against the cheek portions and the chin portion is increased.

As described above, the helmet according to first and second aspects of the present invention is a helmet in which the face of the helmet wearing person can be held at a larger area than the restricted wearing area even if the wearing area at the shell for supporting the cheek pads is restricted, and further the plane-like member (plate member, sheet member) having a less amount of extending or shrinkage or a molded plate is adhered to cause a strength to be assured at the protrusions, resulting in that a superior helmet wearing feeling is assured and further a quite superior making helmet comfortable with no disadvantage of looseness or the like is attained.

In addition, the plane-like member or the molded plate is made of soft raw material not damaging the helmet wearing person and further adhered to the slant surfaces of the protrusions, i.e. the outer surfaces, so that their influences against the cheek portions or the chin portion of the helmet wearing person are not present at all and they are quite safe.

Additionally, it can be accomplished by a quite simple structure in which either the plane-like member or the molded plate is adhered to the cushion member, so that it can be manufactured in a low cost and it can be provided in a substantial similar price to that of the prior art product.

In addition, since the molded plate of the helmet according to second aspect of the present invention is made such that a spring force to shrink inwardly on the protrusions as well as the repelling resilient force of the cushion member is applied to it, the contact force of the protrusions against the cheek portions and the chin portion of the protrusions is increased, so that it is quite effective in view of accomplishing a higher making helmet comfortable.

Accordingly, the present invention can provide a helmet in which a high safety characteristic is assured against the helmet wearing person by realizing a quite superior stability and wearing characteristic, further its price is reasonable and it is quite practical.

DESCRIPTION OF THE PREFERRED EMBODIMENTS

Figure 1:
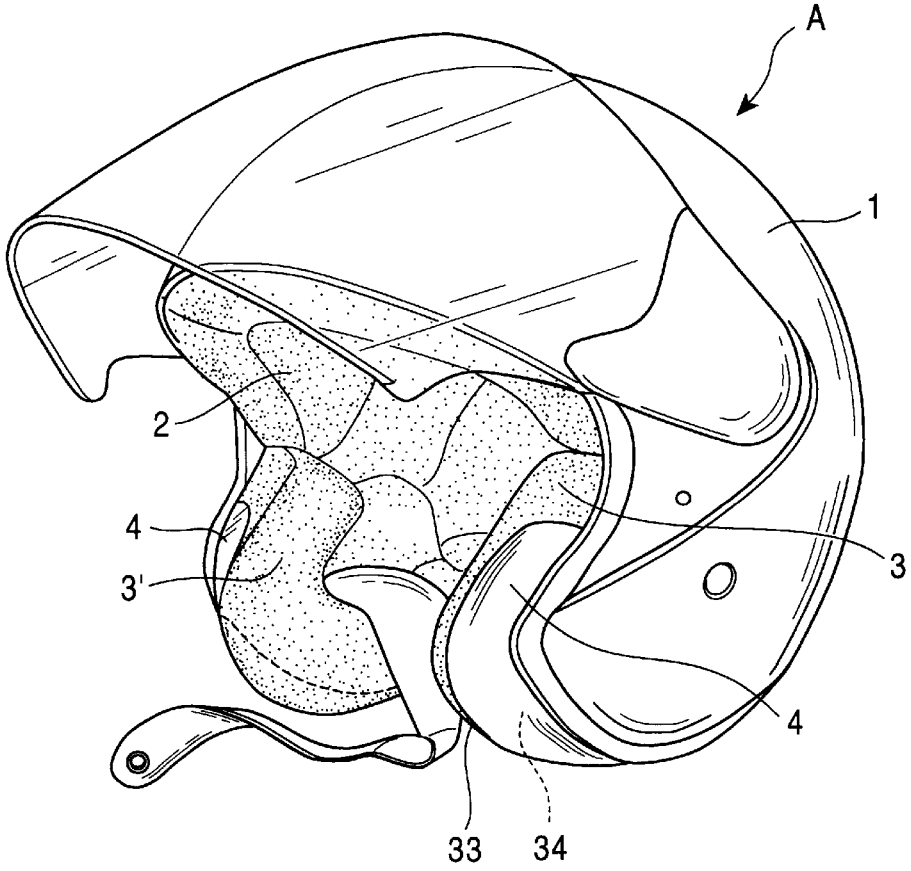
FIG. 1 is a perspective view of an open face type helmet in accordance with the present invention.
Figure 2:
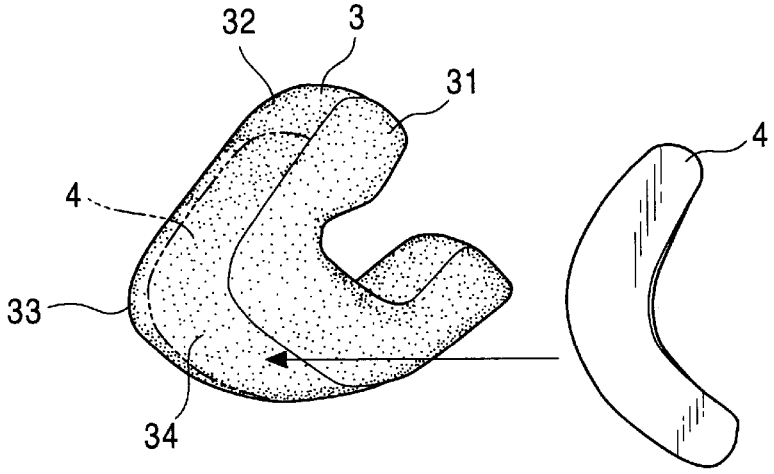
FIG. 2 is an exploded view of a portion of the helmet of FIG. 1 showing how a plate member is adhered to the slant surfaces of the cheek pads.
Figure 3:
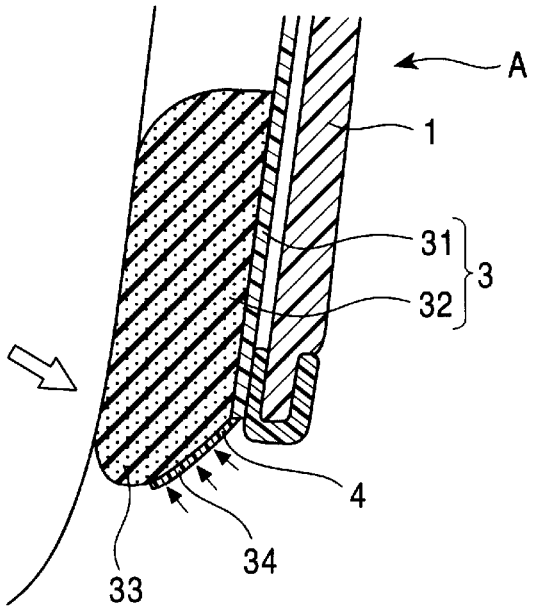
FIG. 3 is a sectional view for schematically illustrating an arranging location of the cheek pad shown in FIG. 1.

Referring now to the drawings, some preferred embodiments of the present invention will be described, wherein FIGS. 1 to 3 illustrate a first preferred embodiment of an open face type helmet of the present invention.

The open face type helmet A is of well-known form including a shock absorbing liner (not shown) made of expanded polystyrene foam or raw material having the same or more shock absorbing performance, an inner liner 2 made of urethane material arranged inside the shock absorbing liner and cheek pads 3, 3' arranged at both sides and corresponding to the cheek portions and the chin portion which are installed inside the shell 1 that has been formed into a predetermined shape with fiber reinforced resin.

The cheek pads 3, 3' are symmetrical in lateral direction, so that only one of the right and left pads will be described as follows.

The cheek pad 3 has a substantial U-shape to provide open area at locations corresponding to the ears of the helmet wearing person, and includes a base member 31 forming this shape and a cushion member 32 made of urethane laminated and adhered to an inner side of the base member 31.

The cushion member 32 is sufficiently soft and resilient to cause no as irregular feeling or pain to a user. A cheek contacting area is made wider than an adhering side area of the base member 31, and as shown in FIG. 3, there may be formed a protrusion 33 with a surface ranging from the location corresponding to the end part of the base member 31 to the front end and the lower end formed as a slant surface 34. A plane-like member 4 assuring strength of the protrusion 33 is adhered to the slant surface 34.

In the following description, the plane-like member 4 is explained as a plate member, and it is described hereinafter with a reference number 4 being affixed to it.

The plate member 4 is made of soft raw material having a less amount of extending or shrinkage and having a strength not damaging the helmet wearing person, it has substantially the same area as that of the slant surface 34 at the protrusion 33 as shown in FIG. 2 and it is formed into such a shape to be adhered to substantially the entire region of the slant surfaces 34.

The plate member 4 made in this way is curved and deformed along the shape of the slant surface 34 and adhered to it, thereby the extending or shrinkage of the protrusion 33 is restricted, and a predetermined strength is assured in the protrusion 33 so as to restrict the bending deformation.

Since the open face type helmet A constructed as described above is made such that the plate member 4 is adhered to restrict the bending deformation of the protrusion 33, the protrusion 33, when installed, can be tightly abutted against the cheek portions and the chin portion.

Figure 4:
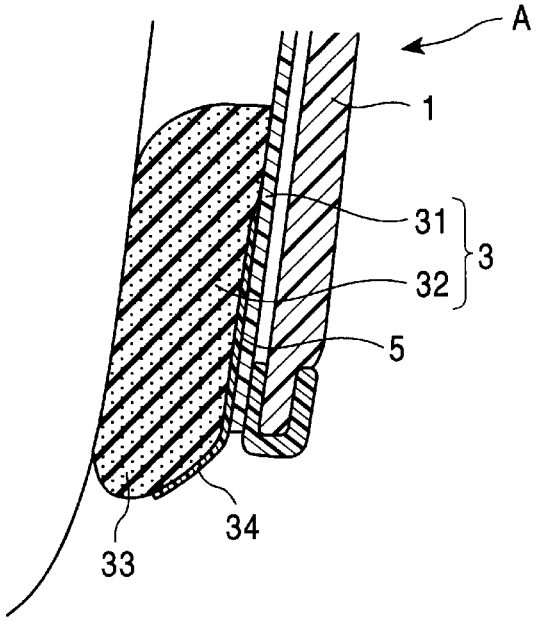
FIG. 4 is a sectional view for schematically illustrating an arranging location of the cheek pad in accordance with second preferred embodiment.

Next, referring to FIG. 4, a second preferred embodiment of the present invention will be described.

Since the open face type helmet of the preferred embodiment is comprised of a molded plate 5 described below in place of the plate member 4 in the aforesaid first preferred embodiment, so that its illustration is only for the cheek pad location and as per the part of which configuration is overlapped to it, its description will be eliminated by affixing the same reference numerals.

The aforesaid molded plate 5 is adhered to the cheek pad 3 at the location ranging from the adhering surface of the base member 31 in the cushion member 32 to the front end and the lower end of the slant surface 34.

The molded plate 5 is made of soft raw material having such a strength as one not damaging the user, an inverse ←shaped section corresponding to the surface shape ranging from the adhered surface of the base member 31 in the cushion member 32 to a part near the lower end of the slant surface 34 and it is molded into such a shape as one corresponding to the part positioned at the adhering side surface of the base member 31 in the cushion member 32 and one corresponding to the shape of the slant surface 34.

The molded plate 5 formed in this way is located at the position set in the adhering side surface of the base member 31 in the cushion member 32 and the slant surface 34 and entirely adhered at its entire surface and thereafter the cushion member 32 and the base member 31 having the molded plate 5 adhered thereto are laminated and adhered to constitute the cheek pad 3.

In this way, the extending or shrinkage of the protrusion 33 is restricted to assure a predetermined strength at the protrusion 33 and then its bending deformation is restricted.

Accordingly, also in the case of the open face type helmet A of this preferred embodiment, the bending deformation of the protrusion 33 is restricted by the molded plate 5, so that the protrusion 33, when installed, can be tightly abutted against the cheek portions and the chin portion.

In addition, in accordance with the arrangement in which the molded plate 5 is installed, a force (a spring force) shrinking inward acts on the protrusion 33 which is apt to expand outwardly by the cheek portions and the chin portion of the helmet wearing person, resulting in that a contact force of the protrusion 33 against the cheek portions and the chin portion is increased.

Figure 5:
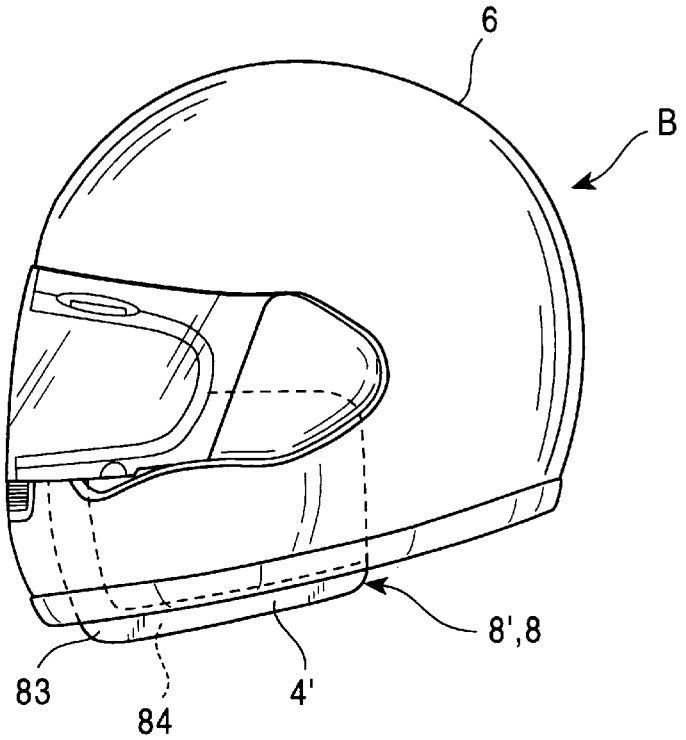
FIG. 5 is a s ide elevational view showing a full-face type helmet in accordance with a third preferred embodiment.
Figure 6:
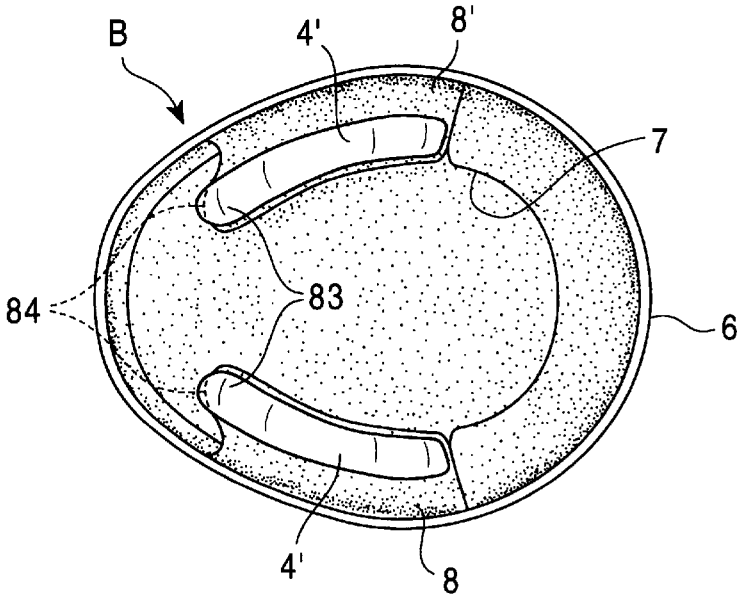
FIG. 6 is a bottom view of FIG. 5.
Figure 7:
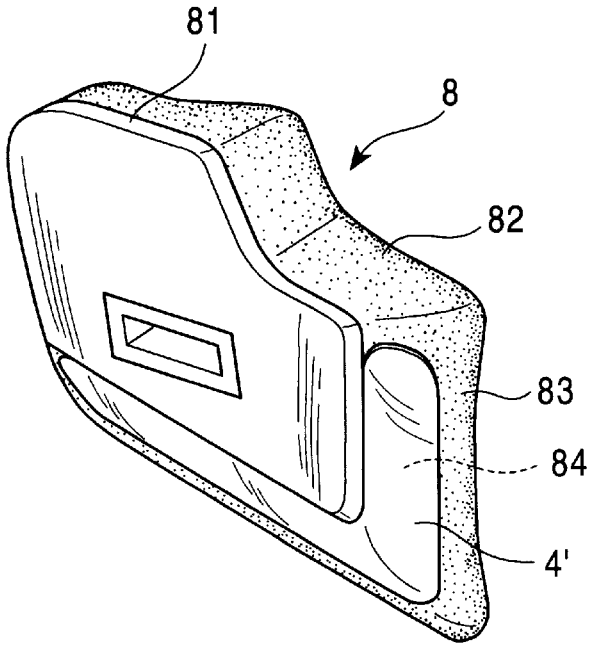
FIG. 7 is a perspective view showing the cheek pad.

FIGS. 5 to 7 illustrate a full-face type helmet B of a third preferred embodiment of the present invention.

The full-face type helmet B is of nowadays well-known form including a shock absorbing liner (not shown) made of expanded polystyrene foam or raw material having the same or more shock absorbing performance, an inner liner 7 made of urethane material arranged inside the shock absorbing liner and cheek pads 8, 8' removably arranged at both sides corresponding to the cheek portions and the chin portion which are installed inside the shell 6 formed into a predetermined shape with fiber reinforced resin.

Fixing or removing structure of cheek pads 8, 8' has a well-known structure and its detailed description is not made, and the cheek pads 8, 8' are symmetrical in lateral direction, so that only one of the right and left pads will be described as follows.

The cheek pad 8 is of a well-known form in the full-face type helmet B, wherein it includes a base member 81 made of raw materials such as synthetic resin or expanded polystyrene foam having a shock absorbing performance and a cushion member 82 made of urethane laminated and adhered to the inner side of the base member 81.

The cushion member 82 has such a soft resiliency as one not showing any irregular feeling or pain against the helmet wearing person, wherein a cheek contacting area is made wider than an adhering side area of the base member 81, and as shown in FIG. 7, there may be formed a protrusion 83 with a surface ranging from the location corresponding to the end part of the base member 81 to the front end and the lower end being applied as the slant surface 84.

A plate member 4' assuring strength of the protrusion 83 is adhered to the slant surface 84.

The plate member 4' is made of the same raw material as that of the first preferred embodiment, it has a substantial same area as that of the slant surface 84 at the protrusion 83 as shown in FIG. 7 and it is formed into such a shape as one in which it can be adhered to a substantial entire region of the slant surfaces 84.

The plate member 4' made in this way is curved and deformed along the shape of the slant surface 84 and adhered to it, thereby the extending or shrinkage of the protrusion 83 is restricted, a predetermined strength is assured in the protrusion 83 so as to restrict its bending deformation.

Accordingly, since also in the case of the full-face type helmet B of the third preferred embodiment, the plate member 4' is adhered to restrict the bending deformation of the protrusion 83, similar actions and effects to those of the aforesaid open face type helmet A of the second preferred embodiment can be attained.

Figure 8:
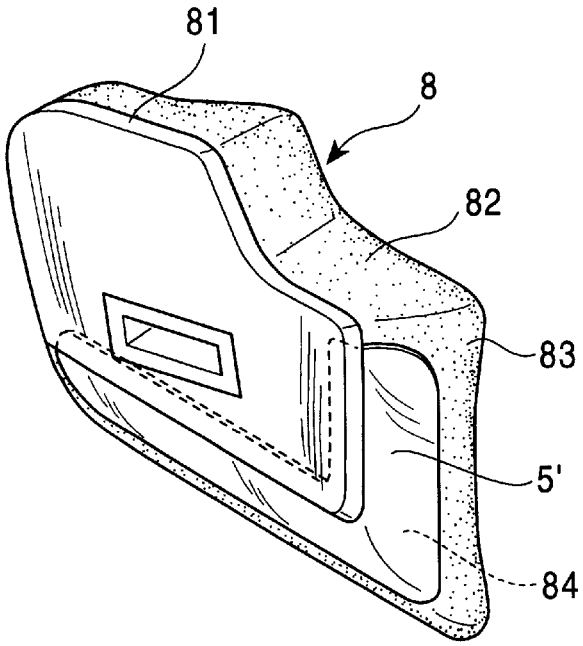
FIG. 8 is a perspective view showing a cheek pad in a full-face type helmet in accordance with a fourth preferred embodiment.

Next, referring to FIG. 8, a fourth preferred embodiment of the present invention will be described.

Since this preferred embodiment is of a full-face type helmet B and its basic form is similar to that of the third preferred embodiment, its description and an entire illustration of the helmet are eliminated and only the cheek pad 8 is extracted out of it, illustrated and described.

This cheek pad 8 is made such that the molded plate 5' made of soft raw material having a strength not damaging the helmet wearing person, molded into a shape corresponding to a location positioned at the adhering side surface of the base member 81 at the cushion member 82 and corresponding to a shape of the slant surface 84 is adhered in the same manner as that of the aforesaid second preferred embodiment over a location ranging from the adhering side surface of the base member 81 at the cushion member 82 to a part near the front end and the lower end of the slant surface 84, and in this way, the extending or shrinkage of the protrusion 33 is restricted by the molded plate 5' to assure a predetermined strength at the protrusion 33 and then its bending deformation is restricted.

Accordingly, also in the case of the full-face type helmet B of this fourth preferred embodiment, the bending deformation of the protrusion 83 is restricted by the molded plate 5', so that the similar actions and effects to those of the open face type helmet A in the aforesaid second preferred embodiment can be attained.

In this preferred embodiment, it has been described in reference to the fixed type in which the cheek pads are removably attached to the shell. However, it is not limited to the system in which it is removably attached, and the plate members 4, 4' and the molded plates 5, 5' can be employed also in the system in which the cheek pads are adhered to and fixed to the shell.

In the preferred embodiment, it has been described in reference to the system in which the plane-like member is applied as a plate member. However, it is not limited to this material and the material of soft raw material having a less amount of extending or shrinkage characteristic and having a strength not damaging the helmet wearing person may also be applied, wherein as its example, a sheet material (not shown) can be applied.

In addition, as a form of the fixed type cheek pad in the full-face type helmet, there may be provided a product (not shown) constituted such that the raw material such as expanded polystyrene foam having a shock absorbing performance is used, the cushion member made of the same raw material as that of the aforesaid preferred embodiments is adhered and fixed at both locations corresponding to right and left cheeks of right and left integral base members of substantial U-shaped section as seen in its top plan view which are integrally formed along a shape ranging from the location corresponding to one of the right and left cheeks of the shell to the location corresponding to the opposite cheek portion through the chin guard.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A helmet which comprises a shell and cheek pads therein to contact cheeks of a wearer so as to restrict looseness of the helmet, said cheek pads including a cushion member having protrusions defining slant surfaces that are inclined downwardly from a shell side toward a wearer's cheeks in a thickness direction and are cooperatively arranged at a front or lower section of the cushion member for said cheek pads, whereby the surfaces of the cheek pads contacting a face of the wearer are larger than those supported at the shell side, and a soft plane-like member having a reduced extension or shrinkage is adhered to the slant surfaces so that extension or shrinkage of the cushion member near the slant surfaces is restricted and a desired strength is also assured at said protrusions.

2. A helmet which comprises a shell and cheek pads therein to contact cheeks of a wearer so as to restrict looseness of the helmet, said cheek pads including a cushion member having protrusions defining slant surfaces that are inclined downwardly from a shell side toward a wearer's cheeks in a thickness direction and are cooperatively arranged at a front or lower section of the cushion member for said cheek pads, whereby the surfaces of the cheek pads contacting a face of the wearer are larger than those supported at the shell side, and a soft molded plate not damaging a wearer is adhered to the cheek pads so that extension or shrinkage of the cushion member near the slant surfaces is restricted and a desired strength is also assured at the protrusions.

* * * * *